United States Patent [19]

Horie et al.

[11] Patent Number: 4,869,189

[45] Date of Patent: Sep. 26, 1989

[54] EDGE TRACING SEWING MACHINE CAPABLE OF AUTOMATICALLY ADJUSTING NEEDLE POSITION

[75] Inventors: Fujio Horie; Takafumi Tanaka, both of Nagoya, Japan

[73] Assignee: Brother Kogyo Kabushiki Kaisha, Japan

[21] Appl. No.: 191,963

[22] Filed: May 9, 1988

[30] Foreign Application Priority Data

May 14, 1987 [JP] Japan ..... 62-118031

[51] Int. Cl.[4] ..... D05B 3/02

[52] U.S. Cl. ..... 112/453; 112/153; 112/306

[58] Field of Search ..... 112/453, 153, 456, 457, 112/121.11, 306, 308, 443

[56] References Cited

U.S. PATENT DOCUMENTS

| | | | |
|---|---|---|---|
| 4,248,168 | 2/1981 | Hoffman | 112/453 |
| 4,318,357 | 3/1982 | Minalga et al. | 112/453 |
| 4,340,002 | 7/1982 | Hanyu et al. | 112/453 |
| 4,664,048 | 5/1987 | Naganuma et al. | 112/453 |

FOREIGN PATENT DOCUMENTS

| | | |
|---|---|---|
| 0075960 | 4/1983 | European Pat. Off. . |
| WO86/04845 | 8/1985 | PCT Int'l Appl. . |
| 2005049 | 4/1979 | United Kingdom . |
| 1586464 | 3/1981 | United Kingdom . |

*Primary Examiner*—Peter Nerbun

*Attorney, Agent, or Firm*—Oliff & Berridge

[57] ABSTRACT

A sewing machine for forming successive stitches along an edge of a workpiece, including an endwise reciprocable sewing needle, a feeding device for feeding the workpiece in a feed direction, in synchronization with reciprocations of the needle, a control motor for changing a relative position between the needle and the workpiece in a lateral direction perpendicular to the feed direction, an edge sensor generating an output signal corresponding to a position relative to the workpiece edge in the lateral direction, and a position control device for receiving the output signal from the sensor in synchronization with the needle reciprocations and applying to the control motor a drive signal to control the relative position between the needle and the workpiece edge. The drive signal is determined based on the output signal of the sensor. A signal delay device is provided to delay the application of the drive signal to the control motor, with respect to the generation of the output signal from the sensor, by a time interval corresponding to a feeding movement of a detected portion of the workpiece to a lowered position of the needle.

9 Claims, 7 Drawing Sheets

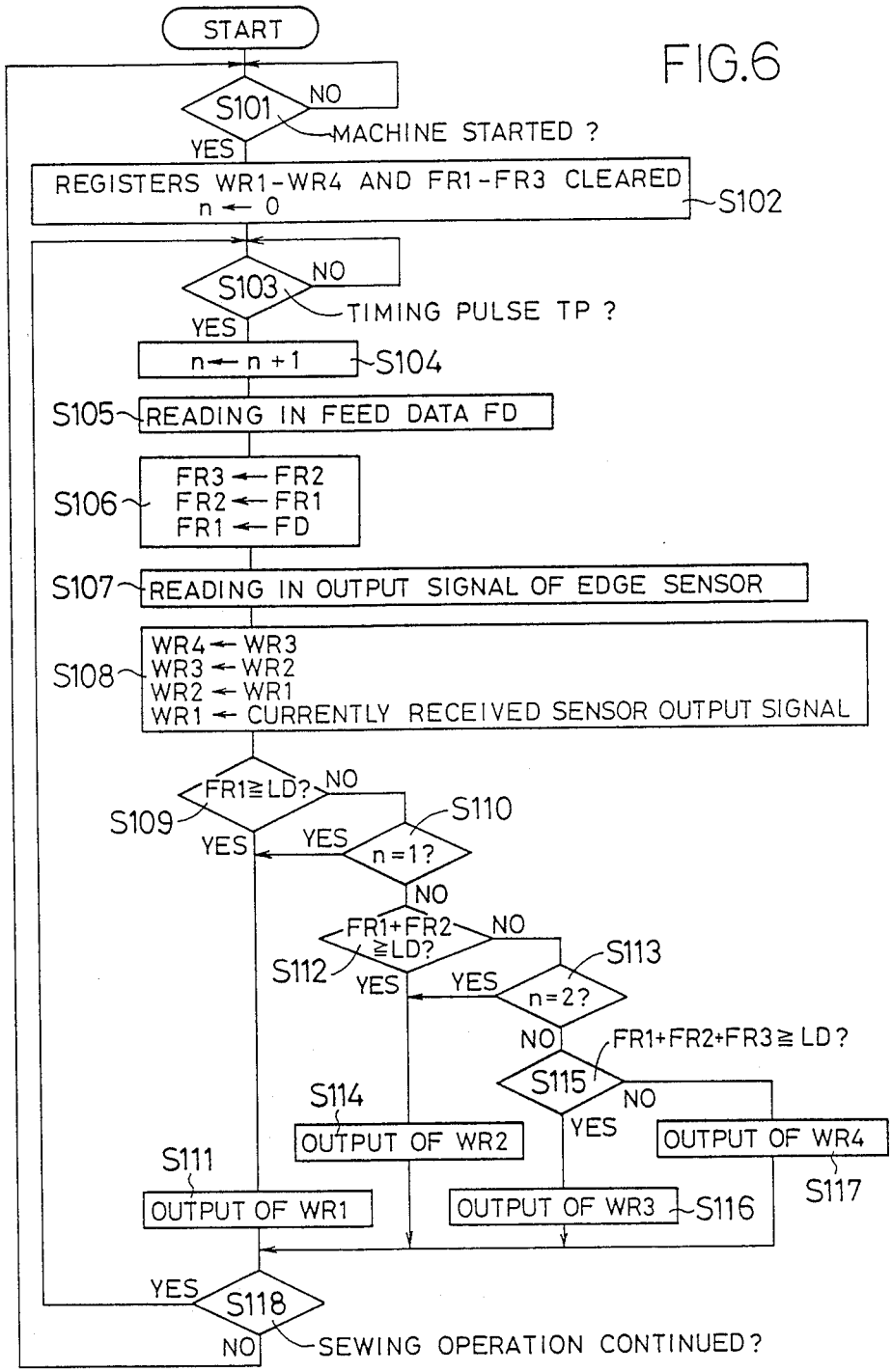
START
FIG.6
S101
NO
MACHINE STARTED ?
YES
REGISTERS WR1-WR4 AND FR1-FR3 CLEARED
n ← 0
S102
S103
NO
TIMING PULSE TP ?
YES
n ← n + 1
S104
S105
READING IN FEED DATA FD
S106
FR3 ← FR2
FR2 ← FR1
FR1 ← FD
S107
READING IN OUTPUT SIGNAL OF EDGE SENSOR
S108
WR4 ← WR3
WR3 ← WR2
WR2 ← WR1
WR1 ← CURRENTLY RECEIVED SENSOR OUTPUT SIGNAL
S109
FR1≧LD?
NO
YES
S110
YES
n=1?
NO
S112
FR1+FR2 ≧LD?
NO
YES
S113
YES
n=2?
NO
FR1+FR2+FR3≧LD?
S115
NO
YES
S114
OUTPUT OF WR2
OUTPUT OF WR4
S117
S111
OUTPUT OF WR1
OUTPUT OF WR3
S116
YES
S118
NO
SEWING OPERATION CONTINUED?

EDGE TRACING SEWING MACHINE CAPABLE OF AUTOMATICALLY ADJUSTING NEEDLE POSITION

BACKGROUND OF THE INVENTION

1. Field of the Invention

The present invention relates to a sewing machine having a function of tracing the edge of a workpiece, and more particularly to such an edge tracing sewing machine wherein the detection area of an edge sensor is offset a certain distance away from a lowered position of a sewing needle (hereinafter referred to as "lowered needle position", if appropriate) in the feed direction of the workpiece.

2. Discussion of the Prior Art

An edge tracing sewing machine is known according to laid-open Publication No. 61-257675,the subject matter of which is incorporated in U.S. Pat. No. 4,664,048. In this sewing machine, the edge of a workpiece or work fabric is detected by an arrangement which includes (i) a feeding device for feeding the workpiece in a predetermined feed direction, in synchronization with an endwise reciprocable sewing needle, (ii) a control motor for changing a relative position between the needle and the workpiece in a lateral direction perpendicular to the feed direction of the workpiece, (iii) an edge sensor having a detection area on a work bed, and generating an output signal corresponding to a position relative to an edge of the workpiece in the detection area in the lateral direction, and (iv) position control means for receiving the output signal of the edge sensor in synchronization with the endwise reciprocations of the needle, and applying to the control motor a drive signal to control the relative position between the needle and the workpiece endge. The drive signal is determined based on the output signal of the edge sensor, so that successive stitches are formed along the workpiece edge.

In the edge tracing sewing machine of the type described above, it is physically difficult to dispose the edge sensor such that the position at which the edge sensor detects the workpiece edge is aligned with a stitch forming position of the machine in the direction of feed of the workpiece. For this reason, the detection area of the edge sensor is usually offset a certain distance away from a lowered position of the sewing needle (i.e., stitch forming position) on the upstream side in the feed direction of the workpiece.

Accordingly, the portion of the workpiece which is detected by the edge sensor (detected portion of the workpiece) is different from the portion of the workpiece which is sewn by the needle whose lateral position is regulated according to an output signal of the edge sensor. In the case where stitches are formed along a straight line parallel to the workpiece feed direction, the fact indicated above does not cause a problem. However, in the case of a sewing operation wherein stitches are formed along a curved edge of the workpiece, the distance between the stitch positions and the workpiece edge tends to be fluctuated if the edge sensor or detected portion of the workpiece is offset from the lowered needle position or stitch forming position of the workpiece.

SUMMARY OF THE INVENTION

It is accordingly an object of the present invention to provide an edge tracing sewing machine which has an edge sensor whose detecting position is offset from a stitch forming position in a feed direction of the workpiece, and which is capable of forming stitches along the edge of the workpiece, with a constant distance between the stitch positions and the workpiece edge.

The above object may be accomplished according to the principle of the present invention, which provides a sewing machine for forming successive stitches along an edge of a workpiece, comprising: an endwise reciprocable sewing needle; a feeding device for feeding the workpiece in a feed direction, in synchronization with endwise reciprocations of the needle; a control motor for changing a relative position between the needle and the workpiece in a lateral direction perpendicular to the feed direction; an edge sensor having a detection area on a work bed, and generating an output signal corresponding to a position relative to an edge of the workpiece in the detection area in the lateral direction; position control means for receiving the output signal from the edge sensor in synchronization with the endwise reciprocations of the needle, and applying to the control motor a drive signal to control the relative position between the needle and the edge of the workpiece, the drive signal being determined based on the output signal; and signal delay means for delaying the application of the drive signal to the control motor, with respect to the generation of the output signal from the edge sensor, by a time interval corresponding to a feeding movement of the workpiece by the feeding device from the detection area of the edge sensor to a lowered position of the needle.

In the sewing machine of the present invention constructed as described above, the signal delay means which receives the output signal of the edge sensor is operable to delay the supply of the sensor output signal to the position control means, or delay the supply of the drive signal from the position control means to the control motor, thereby delaying the application of the drive signal based on the sensor output signal, to the control motor, with respect to the reception of the output signal from the edge sensor, by a time interval which corresponds to a feeding movement of the workpiece by the feeding device from the detection area of the edge sensor to the lowered needle position. In the present sewing machine, therefore, the output signal of the edge sensor which determines the drive signal to the control motor for changing the relative position between the needle and the workpiece in the lateral direction is used when the portion of the workpiece reaches the stitch forming position, i.e., the lowered position of the needle. Thus, the lateral position of the needle at which a given stitch is formed can be controlled based on the output signal of the edge sensor which corresponds to the portion of the workpiece in which the stitch is formed. In an edge tracing sewing operation along a curved or undulated edge of the workpiece according to the present arrangement, stitches can be formed in a straight line or in a desired pattern, along the curved edge of the workpiece, while maintaining a constant distance between the stitch positions and the workpiece edge, without the operator having to manipulate the workpiece so that the workpiece is fed along a profile of its curved edge.

In one form of the present invention, the delay means may be adapted to determine the time interval depending upon a reference number of penetrations of the needle through the workpiece which occur during the feeding movement of the workpiece. The reference number of penetrations is determined based on an amount of feed of the workpiece of the feeding device for each reciprocation of the needle.

To further clarify the above feature of the invention, it is assumed that four reciprocations of the needle occurs while the workpiece is fed from the detection area of the edge sensor to the lowered needle position, with a constant or varying feed amount per reciprocation of the needle. In other words, four feeding motions of the feeding device cause the workpiece to be fed from the detection area of the sensor to the lowered needle position. In this case, the portion of the workpiece which was detected by the edge sensor is sewn by the fourth fourth penetration of the needle through the workpiece, as counted after the relevant workpiece portion is detected by the sensor. Accordingly, if the output signal of the edge sensor generated upon detection of the relevant workpiece portion is applied to the position control means prior to the fourth penetration of the needle (after the lifting of the needle following the third penetration), the lateral relative position between the needle and the workpiece for sewing each portion of the workpiece detected by the edge sensor can be controlled based on the output signal of the edge sensor which is generated upon detection of the relevant portion of the workpiece. The same result may be obtained, where the drive signal produced by the position control means based on the relevant output signal of the sensor is applied to the control motor prior to the fourth penetration of the needle. In other words, the moment at which a drive signal correspinding to a sensor output signal is applied to the control motor is delayed with respect to the moment of reception of the sensor output signal by the signal delay means, by a time interval corresponding to three reciprocations of the needle.

Where the workpiece is fed by a substantially constant distance for each reciprocation of the needle, it is preferred that the signal delay means comprises dividing means for dividing an offset distance in the feed direction between the detection area of the edge sensor and the lowered position of the needle, by an incremental feed distance of the workpiece by the feeding device, to determine the reference number of penetrations of the needle. In this case, the processing time for calculating the reference number of needle penetrations can be comparatively short, since summing and determining steps as indicated below are not necessary.

However, where the feed amount of the workpiece should be varied frequently depending upon the individual reciprocations of the needle, it is desirable that the signal delay means further comprise: summing means for summing individual feed amounts of the workpiece by the feeding device in synchronization with the reciprocations of the needle, and thereby obtaining a sum of the feed amounts; and determining means for determining whether the sum sufficiently approximates to an offset distance in the feed direction between the detection area of the edge sensor and the lowered position of the needle. In this case, the reference number of penetrations of the needle is determined based on the number of the feed amounts which have been summed until the determining means obtains an affirmative decision. The instant arrangement permits an edge tracing sewing with high accuracy of positioning of the needle and the workpiece relative to each other, even where the feed amount of the workpiece is varied for successive reciprocations of the needle to form a certain stitch pattern.

In one arrangement of the above feature of the invention, the summing means comprises a plurality of feed amount registers which stores the feed amounts and which are consecutively numbered in an increasing order, and sequential adding means for adding to a content of a lowest-numbered one of the registers a content of a next one of the registers which is next to the lowest-numbered register in the increasing order, and thereby obtaining a first sum of feed amounts. The sequential adding means obtains second and following sums of feed amounts by adding to the content of each of the following registers a sum of the contents of the registers whose numbers are smaller than that of each of the following registers. The determining means sequentially compares each of the first, second and following sums, with the offset distance, and obtains the affirmative decision when one of the sums exceeds the offset distance for the first time.

The signal delay means may further comprise a plurality of sensor signal registers for storing the output signal of the edge sensor, shift control means, and steady-state signal supply means. The registers are numbered by consecutive integers which are incremented from "1". The shift control means stores a current value of the output signal of the edge sensor in a first one of the sensor signal registers whose number is "1", each time the needle is lifted from the lowered position. The shift control means is adapted to shift contents of the sensor signal registers, from each one of the registers to a following one of the registers; The steady-state signal supply means applies to the position control means the output signal stored in one of the sensor signal registers whose number is equal to the reference number of penetrations of the needle, during a steady-state period of an edge tracing sewing operation wherein an actual number of penetrations of the needle through the workpiece is equal to or greater than the above-indicated reference number.

In the above case, the signal delay means may further comprise transient-state signal supply means for applying to the position control means the output signal stored in one of the sensor signal registers whose number is equal to the actual number of penetrations, during an intial period of the edge tracing sewing operation wherein the actual number of penetrations of the needle through the workpiece is smaller than the reference number.

BRIEF DESCRIPTION OF THE DRAWINGS

The foregoing and objects, features and advantages of the present invention will be better understood by reading the following detailed description of presently preferred embodiments of the invention, when considered in connection with the accompanying drawings, in which:

FIG. 6 is a flow chart illustrating a control program of a signal delay device of a tracing control device used in the sewing machine of FIG. 5.

DETAILED DESCRIPTION OF THE PREFERRED EMBODIMENT

The preferred embodiments of the present invention will be described in detail, by reference to the accompanying drawings.

Figure 1:
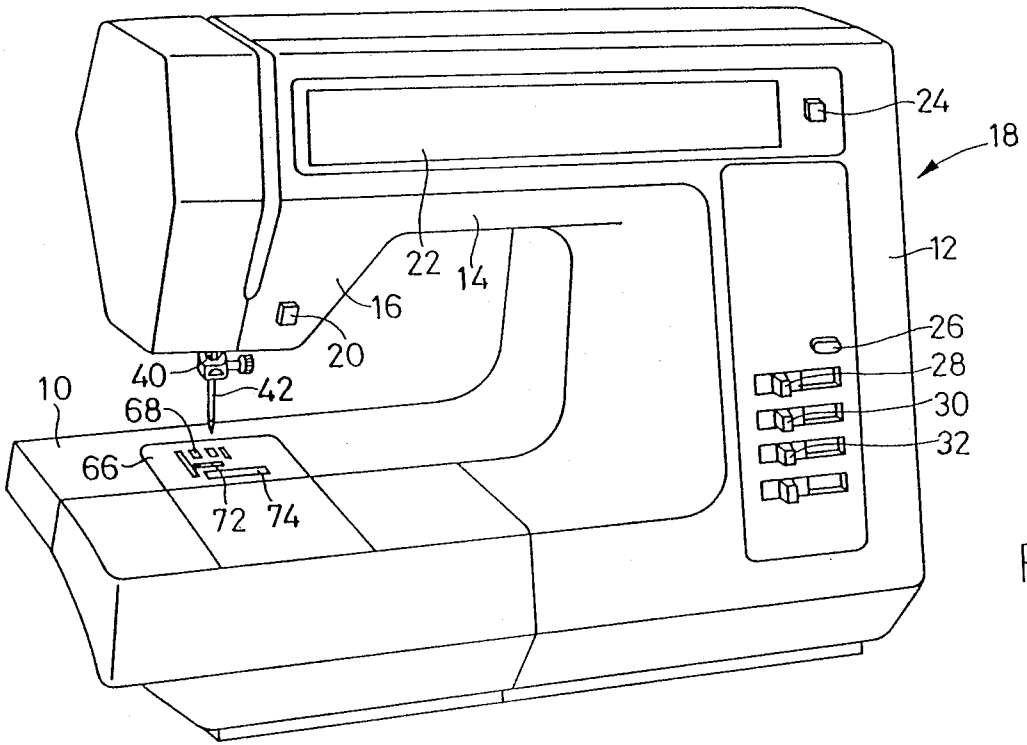
FIG. 1 is a schematic perspective view of one embodiment of an edge-tracing sewing machine of the invention, showing the exterior appearance of the sewing machine.
Figure 2:
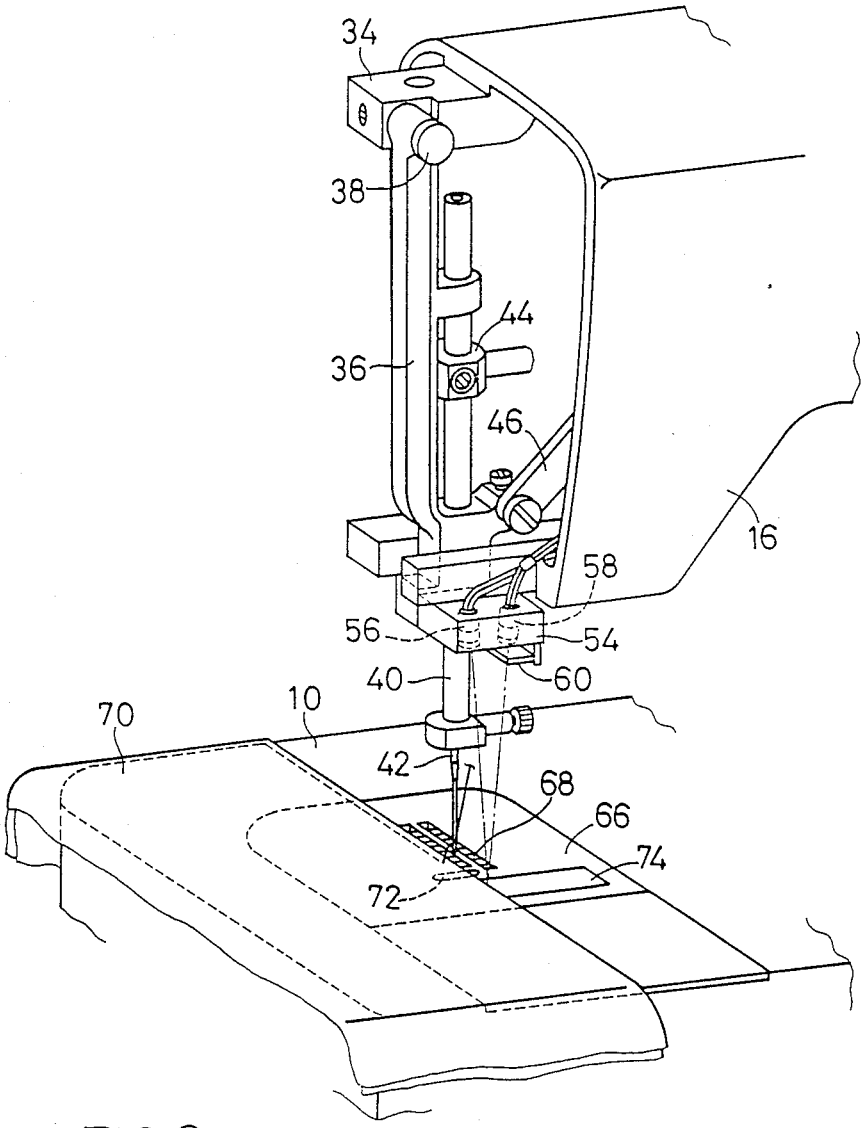
FIG. 2 is a perspective view of a head portion of the sewing machine of FIG. 1, with its head cover removed to show the interior construction of the head portion.

Referring first to FIG. 1, there is illustrated a sewing machine, which includes a work bed 10 (hereinafter simply referred to as "bed 10") having a flat upper surface, a standard 12 rising from the right-hand side end of the bed 10, a bracket arm 14 extending from the upper end of the standard 12 substantially in parallel with the bed 10, and a head 16 provided at the free end of the bracket arm 14. These members 10, 12, 14 and 16 are incorporated in a machine frame 18. The head 16 has a main switch 20 for turning on and off the sewing machine. The bracket arm 14 has a display panel 22 on which there are provided a plurality of indicia indicative of stitch patterns available on the instant sewing machine. The bracket arm 14 further has a pattern select switch 24 for selecting the stitch patterns On the standard 12, there is provided a tracing-mode select switch 26 used to place the sewing machine in a tracing-mode in which a line of stitches are formed a predetermined constant distance away from the edge of a workpiece or work fabric 70 (FIG. 2). There are also provided on the standard 12: a distance setting member 28 for setting the above-indicated predetermined distance between the edge of the work fabric 70 and the line of stitches; a bight adjusting member 30; and a feed adjusting member 32.

Referring next to FIG. 2 showing the interior construction of the head 16 as seen with its covering member removed, there is provided a support member in the form of a needle-bar oscillator 36 which is supported at its one end by a shaft 38 on a projection 34 fixed to the head 16 such that the oscillator 36 is pivotable about the shaft 38 in the vertical plane. On this oscillator 36 is supported a needle bar 40 slidably in the vertical direction. The needle bar 40 is adapted to carry a needle 42 fixed at its lower end, and is connected to a needle drive motor (not shown) via a connecting stud 44 and other members, so that the needle bar 40 and the needle 42 are endwise reciprocated in the vertical direction during an operation of the needle drive motor. On the other hand, the needle-bar oscillator 36 is operatively connected to a bight control motor 100 (FIG. 3) via a connecting rod 46 and other members. With this bight control motor 100 operated, the needle bar 36 is jogged in a lateral direction perpendicular to a feed direction of the work fabric 70, whereby the lateral position of the needle 42 is varied within a predetermined range defined by a leftmost and a rightmost position.

On the needle-bar oscillator 36, there is mounted a sensor 54 such that the sensor is joggable together with the oscillator 36. The sensor 54 includes a light emitter 56 which emits infrared rays, and a photoelectric cell 58 which receives the reflected infrared rays as described later. In the vicinity of the photoelectric cell 58, there is disposed an optical filter 60 which permits the infrared rays to pass therethrough, but does not transmit light rays of other wavelength regions The upper surface of the bed 10 indicated above has an aperture closed by a throat plate 66 having a plurality of slots, through which respective feed dogs 68 are adapted to protrude above the throat plate 66. The feed dogs 68 are given feeding movements or actions by a feed control motor 98 (FIG. 3), and cooperate with a presser foot (not shown) to feed the work fabric 70 in the feed direction perpendicular to the direction of lateral jogging of the needle 42. The throat plate 66 further has an elongate needle hole 72 which is formed in the lateral jogging direction of the needle 42. In the vicinity of the needle hole 72, a reflecting surface 74 is provided on the throat plate 66, such that the length of the surface 74 is parallel to the needle hole 72. This reflecting surface 74 reflects the infrared rays emitted by the light emitter 56 of the edge sensor 54, so that the reflected rays are received by the photoelectric cell 58, as referred to above. The sensor 54 is adapted to detect a change in an amount of the infrared rays which are reflected by a predetermined detection area on the reflector surface 74. The center of the detection area lies at a point which is spaced a predetermined distance away from an intersection (hereinafter referred to as "lowered position of the needle 42") between the centerline of the needle 42 and the plane of the upper surface of the throat plate 66, frontwards (toward the operator) in the feed direction of the fabric 70. That is, the center of the detection area is offset from the lowered position of the needle 42 by a predetermined offset distance (LD). Further, the center of the detection area is spaced away from the lowered position of the needle 42 rightwardly (as seen in FIG. 2) by a predetermined distance in the lateral direction perpendicular to the feed direction of the fabric. The amount of light received by the photoelectric cell 58 decreases with an increase in the surface area of the detecting area which is covered by the work fabric 70. The photoelectric cell 58 generates an output signal which corresponds to the surface area of the detection area which is not covered by the work fabric 70.

Figure 3:
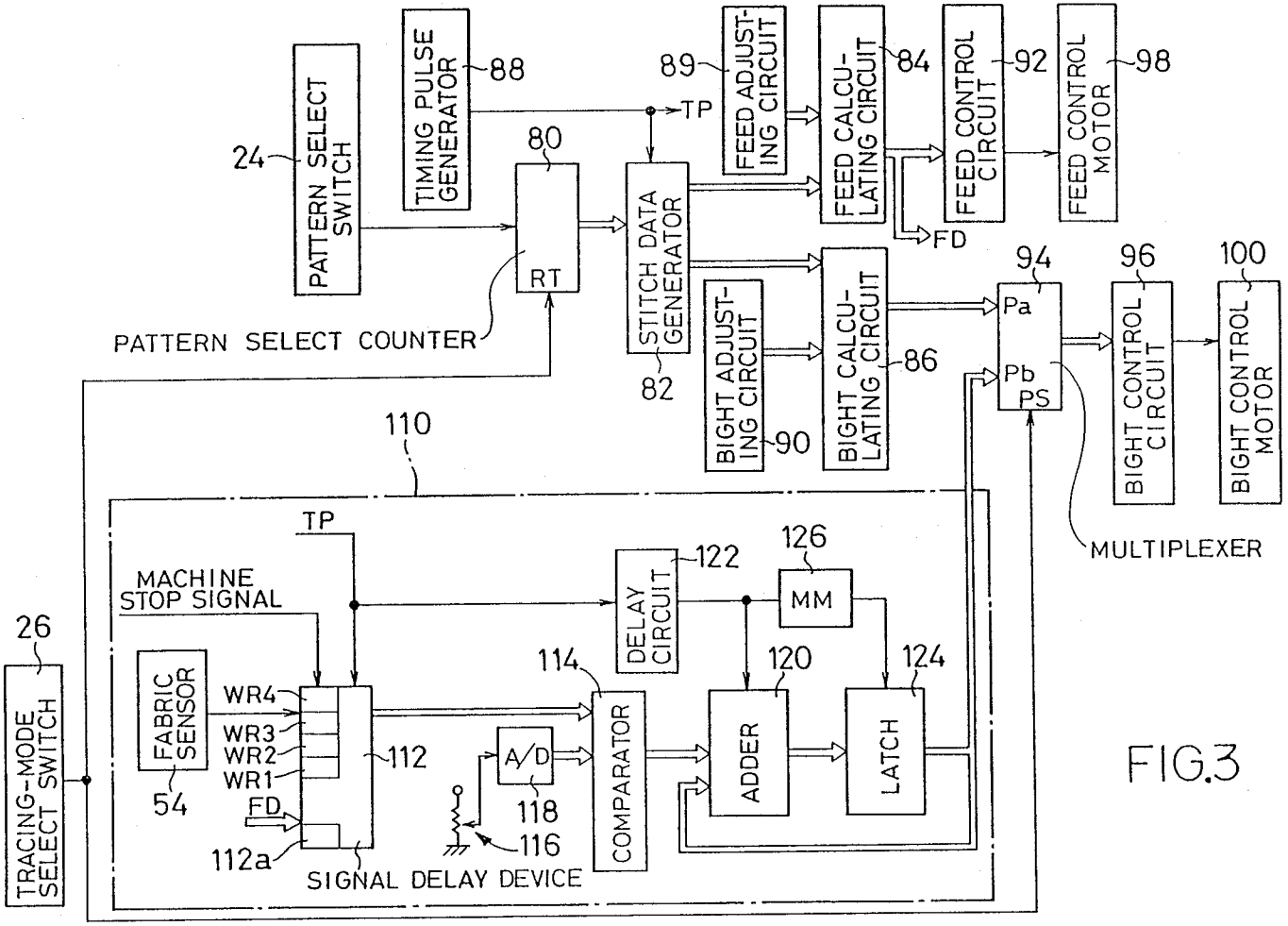
FIG. 3 is a schematic block diagram of a control system of the sewing machine.

Referring to FIG. 3, there is shown a control system of the instant sewing machine. In the figure, the pattern select switch 24 is indicated at the left-upper corner. To this select switch 24, there is connected a pattern select counter 80 which counts the number of operations of the switch 24. A signal representative of the count of the pattern select counter 80 is applied to a stitch data generator 82. According to the varying count of the counter 80, the appropriate one of light emitting diodes incorporated in the display panel 22 is turned on to indicate the currently selected stitch pattern.

The stitch data generator 82 stores sets of stitch data representative of the respective stitch patterns that can be formed in the present sewing machine. The stitch data generator 82 supplies a feed calculating circuit 84 and a bight calculating circuit 86 with the set of stitch data which corresponds to the current count of the pattern select counter 80. Described more specifically, the stitch data generator 82 is supplied with a timing pulse TP which is generated by a timing pulse generator 88 each time the needle bar 40 is reciprocated. Each time the stitch data generator 82 receives the timing pulse TP from the pulse generator 88, feed data FD and bight data of the stitch data are fed to the feed and bight calculating circuits 84, 86, respectively.

A feed adjusting circuit 89 is connected to the feed calculating circuit 84, while a bight adjusting circuit 90 is connected to the bight calculating circuit 86. The feed adjusting circuit 89 supplies the feed calculating circuit 84 with feed adjusting data which is variable by the feed adjusting member 32. The feed calculating circuit 84 multiplies the feed data FD from the generator 82, by the feed adjusting data received from the adjusting circuit 89, and a product obtained by the multiplication is fed to a feed control circuit 92, whereby the feed data FD of the stored stitch data for the selected stitch pattern is adjusted according to the current position of the feed adjusting member 32. Similarly, the bight calculating circuit 86 is adapted to adjust the bight data from the stitch pattern generator 82, according to bight adjusting data received from the bight adjusting circuit 90, which corresponds to the current position of the bight adjusting member 30. The bight data adjusted by the calculating circuit 86 is applied to a bight control circuit 96 via a multiplexer 94. The feed control circuit 92 controls the previously indicated feed control motor 98 to effect controlled feeding movements of the feed dogs 68, while the bight control circuit 96 controls the previously indicated bight control motor 100 to effect controlled lateral jogging movements of the needle 42. In this manner, successive stitches are formed in the pattern selected by the pattern select switch 24.

The tracing-mode select switch 26 is connected to the pattern select counter 80 and to the multiplexer 94. With this switch 26 activated, the pattern select counter 80 is reset. As a result, the stitch data representative of a straight stitch pattern is generated from the stitch data generator 82. At the same time, the multiplexer 94 is switched to a position for applying an output signal (needle position control signal) of a tracing control device 110 to the bight control circuit 96, rather than the output of the bight calculating circuit 86.

The tracing control device 110 includes the edge sensor 54 indicated above, and a signal delay device 112 which receives an output signal of the edge sensor 54 and applies the received output signal of the edge sensor to a comparator 114. The signal delay device 112 (hereinafter referred to as "delay device") is constituted by a microcomputer which includes a CPU (central processing unit), a RAM (random access memory) and a ROM (read-only memory). The delay device 112 is adapted to apply the output signal of the edge sensor 54 to the comparator 114, with a time delay with respect to the generation of the output signal from the edge sensor 54. The length of the time delay is determined depending upon the number (N) of penetrations of the needle 42 through the work fabric 70, which is determined based on the timing pulse TP from the timing pulse generator 88, a MACHINE STOP signal present when the machine is at rest, and the feed data FD from the feed calculating circuit 84. The ROM of the delay device 112 stores a control program represented by the flow chart of FIG. 4. The tracing control device 110 further includes a variable resistor 116 which produces a reference signal. The sliding contact of the variable resistor 116 is moved as the distance setting member 28 is operated. The reference signal produced by the resistor 116 is converted into a digital signal by an A/D converter 118, and the digital signal is fed to the comparator 114, which also receives a digital value of the output signal of the edge sensor 54 from the delay device 112. The comparator 114 produces a signal proportional to a difference between the two digital signals received. The output signal of the comparator 114 is fed to an adder 120. This adder 120 is adapted to add the digital signal from the comparator 114 and a digital signal from a latch 124, each time the adder 120 receives the timing pulse TP from the generator 88 via a delay circuit 122. The timing pulse TP delayed by the delay circuit 122 is further delayed by a mono-multivibrator 126, and is received by the latch 124. The latch 124 holds the content of the adder 120, in response to the delayed timing pulse TP from the mono-multivibrator 126. The output of the latch 124 is supplied as the needle position control signal to the bight control circuit 96, via the multiplexer 94.

In the edge tracing mode of operation on the sewing machine constructed as described above, the operator first sets the work fabric 70 on the work bed 10, such that a desired line of stitches to be formed along the fabric edge is substantially aligned with the center of the needle hole 72. With the tracing-mode select switch 26 activated, the pattern select counter 80 is reset, and the straight stitch pattern is selected, even if any other specific stitch patter has been already selected. At the same time, the multiplexer 94 is switched to its position in which the needle position control signal from the tracing control device 110 is applied to the bight control circuit 96.

With the fabric 70 thus set on the work bed 10, the edge sensor 54 generates an output signal whose value corresponds to an area of a part of the detection area of the edge sensor 54 which is not covered by the fabric 70. The output signal of the sensor 54 is applied to the delay device 112, which delays its output signal with respect to the input signal, i.e., delays the application of the received output signal of the sensor 54 to the comparator 114, by a suitable time interval with respect to the generation of the output signal of the sensor 54.

Figure 4:
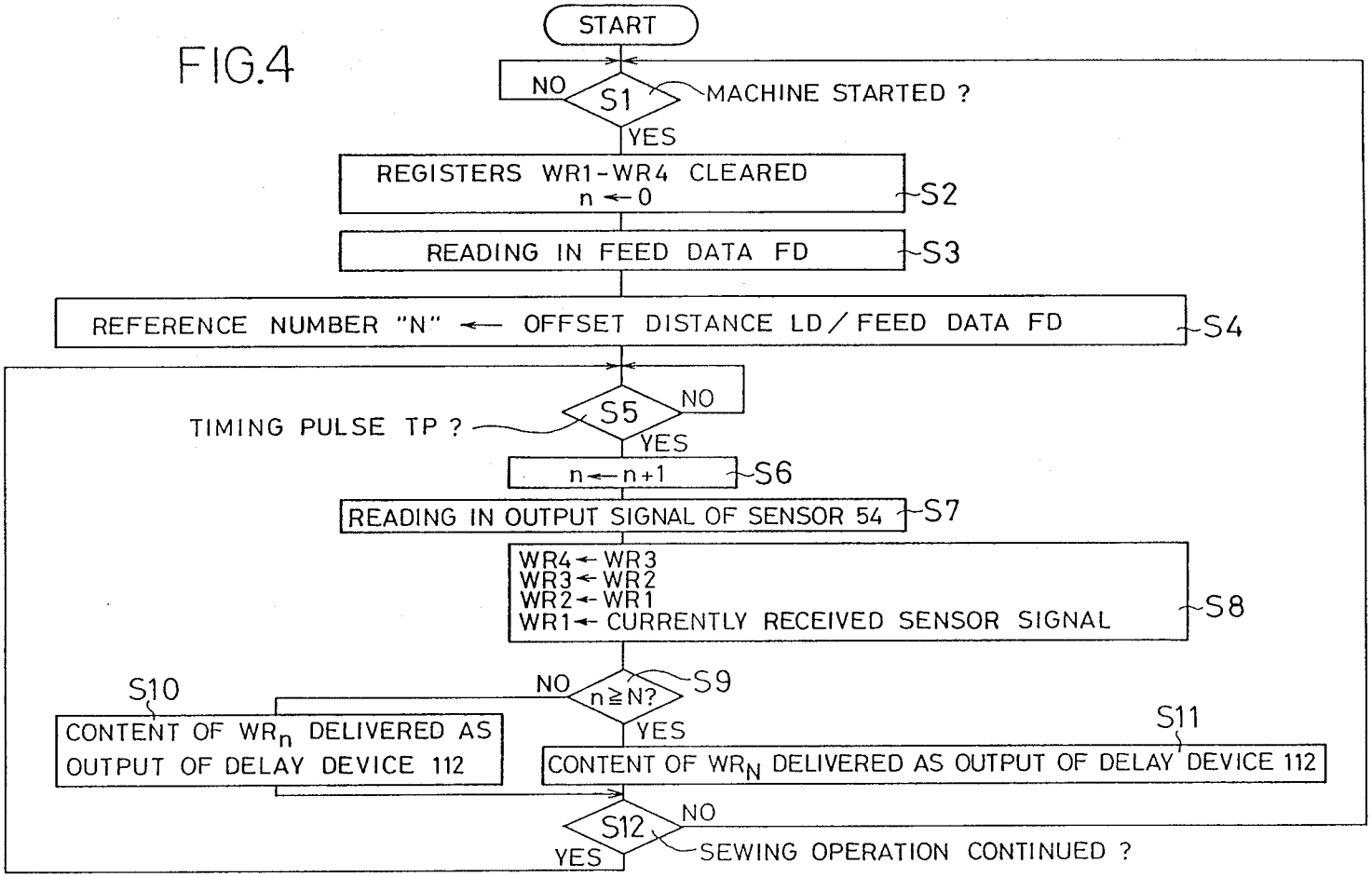
FIG. 4 is a flow chart illustrating a control program stored in a program memory of a signal delay device of a tracing control device.

The time delay of the output of the delay device 112 to the comparator 114 is effected by execution of the control program represented by the flow chart of FIG. 4. Initially, step S1 is repeatedly executed until the sewing machine is turned on. Thus, the delay device 112 waits for the activation of the main switch 20. With the main switch 20 turned on, the control flow goes to step S2. In this step S2, SENSOR SIGNAL registers WR1, WR2, WR3 and WR4 and a PENETRATION counter 112*a* (whose content is indicated at "n" in FIG. 4) of the delay device 112 are cleared or initialized to zero. In the next step S3, the delay device 112 reads in the feed data FD from the feed calculating circuit 84. Step S3 is followed by step S4 in which a reference number "N" of penetrations of the needle 42 through the fabric 70 is determined based on a quotient which is obtained by dividing the offset distance LD of the the detection area of the edge sensor 54 (from the lowered position of the needle 42), by the feed data FD, i.e., by dividing the offset distance LD by the incremental feed distance FD provided for each reciprocation of the needle 42. The offset distance LD from the sensor detection area to the lowered needle position is stored in the ROM of the delay device 112. If the quotient consists of an integer and a fraction, the reference number "N" is obtained by rounding the obtained quotient. It will be understood that the reference number "N" represents the number of reciprocations of the needle 42 which occur while the part of the fabric 70 which is detected by the edge sensor 54 is fed to the lowered position of the needle 42.

Then, the control flow goes to step S5 to determine whether the timing pulse TP from the timing pulse generator 88 is present or not. The timing pulse TP is generated immediately after the needle 42 is lifted off the fabric 70. This step S5 is repeatedly executed until the timing pulse TP is generated. Upon generation of the timing pulse TP, step S5 is followed by step S6 wherein the content "n" of the PENETRATION counter 112*a* is incremented. Then, the control flow goes to step S7 to read in the presently generated output signal of the edge sensor 54, and to step S8 wherein the contents of the SENSOR SIGNAL registers WR3, WR2 and WR1 are stored in the registers WR4, WR3 and WR2, respectively, while the currently received output signal of the sensor 54 is stored in the register WR1. Thus, each time the output signal of the sensor 54 is received by the delay device 112, the contents of the SENSOR SIGNAL registers WR1, WR2 and WR3 are shifted to the registers WR2, WR3 and WR4. With step S8 repeatedly executed, the three values of the output signal of the sensor 54 which have been obtained prior to the reading of the current value are stored in the respective registers WR2, WR3 and WR4. More specifically, the register WR2 stores the value of the output signal of the sensor 54 which was obtained in the last cycle of execution of the control program of FIG. 4 (more precisely, step S7), and the registers WR3 and WR4 store the values obtained two and three cycles prior to the current cycle. The sewing machine according to the present embodiment uses the four SENSOR SIGNAL registers WR1-WR4, since the available lowest amount FD per each reciprocation of the needle 42 is so determined that the portion of the fabric 70 detected by the edge sensor 54 can reach the lowered position of the needle 42 always within four reciprocations of the needle 42, even when the edge tracing sewing operation is effected with the lowest feed amount FD selected. It will be understood that the number of the SENSOR SIGNAL registers WR may be suitable changed, as required.

The control flow then goes to step S9 to determine whether the content "n" of the PENETRATION counter 112*a* is equal to or greater than the reference number "N". If a negative decision (NO) is obtained in step S9, step S10 is executed wherein the content of the SENSOR SIGNAL register WRn is delivered from the delay device 112. Steps S9 and S10 are provided so that the control motor 100 is operated based on the first generated output signal of the sensor 54 stored in the register WRn, while the content "n" of the PENETRATION counter 112*a* is smaller than the reference number "N", namely, before the register $WR_N$ stores the first generated output signal of the sensor 54. If an affirmative decision (YES) is obtained in step S9, the control flow goes to step S11 wherein the content of the register $WR_N$ is delivered from the delay device 112. The content of this register $WR_N$ is the output signal of the sensor 54 which was received (−1) cycles prior to the current control cycle. In the present embodiment wherein the reference number "n" is "3", the register $WR_N$ stores the output signal of the sensor 54 which was received two cycles prior to the current cycle.

Step S11 is followed by step S12 to determine whether the sewing machine is commanded to contine the present sewing operation. If an affirmative decision (YES) is obtained in step S12, steps S5 and subsequent steps are repeated. If a negative decision (NO) is obtained in step S12, the control flow goes back to step S1, and the delay device 112 waits for the start of a new sewing operation.

The output signal (digital signal) of the edge sensor 54 which is thus delayed by the delay device 112 is applied to the comparator 114, together with the reference signal (digital signal) of the variable resistor 116. The comparator 114 compares these two signals with each other, and supplies the adder 120 with an error signal whose value is proportional to a difference between the two signals received. The adder 120 receives the timing pulse TP via the delay circuit 122, which delays the application of the timing pulse TP to the adder 120, by a short time interval with respect to the point of time at which the timing pulse TP is applied to the delay device 112. This time delay is provided to allow for a processing time spent by the delay device 112 before the output of the delay device 112 is applied to the comparator 114. Upon reception of the timing pulse TP, the adder 120 adds the output of the comparator 114 and the output of the latch 124. The obtained sum is held for a very short time in the latch 124.

The digital signal held in the latch 124 is supplied, as the needle position control signal, to the bight control circuit 96 via the multiplexer 94. The bight control motor 100 is operated by a drive signal received from the bight control circuit 96. The drive signal produced by the control circuit 96 represents operating amount and direction of the control motor 100, which are determined by the needle position control signal received from the multiplexer 94. As a result, the needle bar oscillator 36 is laterally jogged, whereby the lateral position of the needle 42 is accordingly changed. Each time the needle 42 is reciprocated, a stitch is formed on the fabric 70, at a position a desired distance away from the fabric edge, so that sucessive stitches are formed along a stitching line which is spaced by the desired distance from the fabric edge. As in an ordinary sewing operation, the size of the stitches to be formed is determined by the feed data FD supplied from the stitch data generator 82, and the feed adjusting data supplied from the feed adjusting circuit 89.

While the stitches are formed with a feeding movement of the work fabric 70, the operator manipulates the fabric 70 so as to maintain the edge of the fabric almost at the predetermined position. Nevertheless, the edge position of the fabric is unavoidably varied to some extent. In this case, however, the value of the output signal of the edge sensor 54 does not coincide with the value of the reference signal from the variable resistor 116, whereby an error signal produced by the comparator 114 is not zero. The error signal is applied to the adder 120. In response to the timing pulse TP received from the delay circuit 122, the adder 120 sums the digital signal from the latch 120 and the digital signal from the comparator 114. Subsequently, the lateral position of the needle 42 is varied as described above. In other words, the lateral position of the needle 42 is automatically varied following a change in the edge position of the fabric, so that the distance between the stitch positions and the fabric edge is held constant.

It will be apparent from the foregoing description that the comparator 114, adder 120, latch 124, multiplexer 94, and bight control circuit 96 constitute a major part of position control means for controlling the bight control motor 100. Further, the portion of the delay device 112 which is assigned to execute steps S3–S5, S7, S8 and S11 constitutes signal delay means for delaying the application of the signal to the comparator 114, with respect to the output signal of the edge sensor 54, i.e., for delaying the application of the drive signal to the control motor 100, with respect to the generation of the output signal of the sensor 54. The portion of the delay device 112 assigned to execute step S4 constitutes dividing means for dividing the offset distance LD by the feed amount or distance FD.

Figure 5:
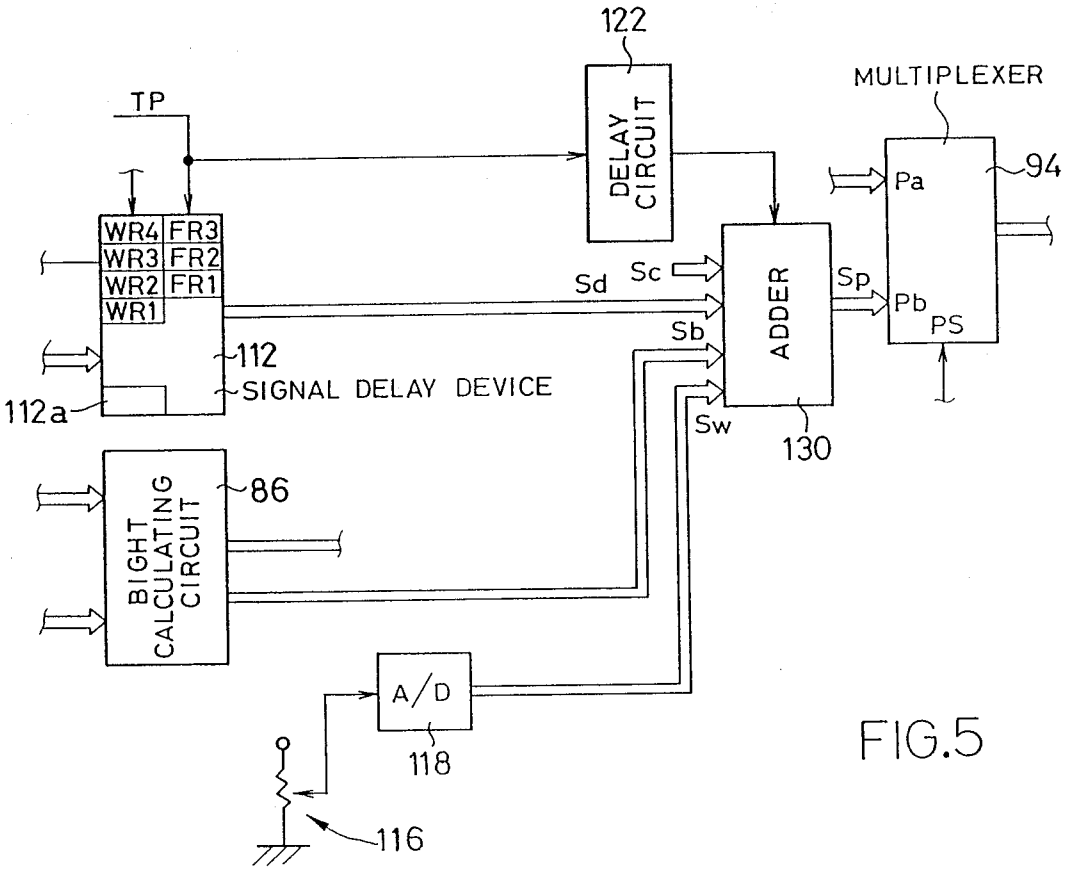
FIG. 5 is a schematic block diagram showing a control system of a sewing machine according to another embodiment of the invention.
Figure 7:
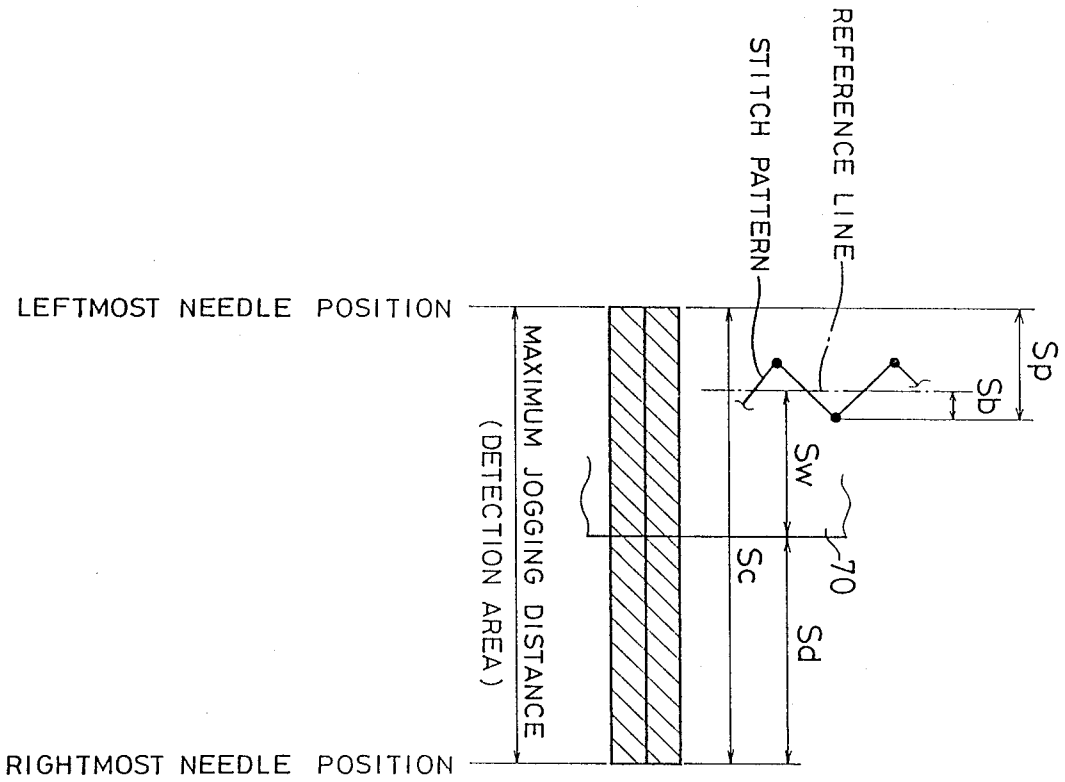
FIG. 7 is a view explaining a manner of controlling the needle position in the sewing machine of FIG. 5.

Referring next to FIGS. 5 through 7, there is illustrated a modified embodiment of the present invention different from the preceding embodiment in some respect. In the interest of brevity and simplification, only the difference of the present embodiment from the preceding embodiment will described.

The sewing machine according to the present modified embodiment uses an edge sensor (not shown) which is a light-transmitting type as disclosed in laid-open publication No. 56-130179 of unexamined Japanese Patent Application. The edge sensor includes a light emitter and a light receiver which are disposed above and below the work fabric 70. The edge sensor generates an output signal indicative of a amount of light which is produced by the light emitted and which is received by the light receiver, without being blocked by the fabric 70. In this embodiment, the light receiver is disposed at a position corresponding to that of the reflecting surface 74 shown in FIG. 2, while the light emitter is secured to the machine frame 16, at a position corresponding to that of the sensor 54 of FIG. 2.

Referring to FIG. 5, there is illustrated a control system of the present sewing machine. The ROM of the delay device 112 stores a control program which is different from that used in the preceding embodiment. The control program used in the present embodiment is shown in the flow chart of FIG. 6. The delay device 112 is connected to the multiplexer 94 via an adder 130. To the adder 130, there are also connected the A/D converter 118 and bight calculating circuit 86 which have been described above.

The adder 130 receives (1) a CONSTANT signal Sc, (2) a SENSOR signal Sd (digital signal) which is an output of the delay device 112, (3) a REFERENCE signal Sw which is an output signal of the variable resistor 116, indicative of a distance between the edge of the fabric 70 and a reference line for a selected stitch pattern, and (4) BIGHT signal Sb which is an output signal of the bight calculating circuit 86. The CONSTANT signal Sc is indicative of a maximum lateral jogging distance of the needle 42, that is, a distance between the rightmost and leftmost positions of the needle. In other words, the value of the CONSTANT signal Sc corresponds to an amount of light received by the light receiver of the edge sensor when the detection area of the edge sensor is not at all overlapped by the fabric 70. The value of the BIGHT signal Sb is positive when the relevant stitch is formed on the right-hand side of the reference line, and negative when the stitch is formed on the left-hand side of the reference line. Each time the timing pulse TP from the timing pulse generator 88 is applied via the delay circuit 122 to the adder 130, an output signal Sp represented by the following equation is produced by the adder 130:

$$Sp = Sc - SD - SW + SB$$

This output signal Sp is indicative of a distance between the leftmost position of the needle 42 and a rightmost stitch position, as indicated in FIG. 7. In the present embodiment, the stitch select counter 80 is not reset when the tracing-mode select switch 26 is activated. Thus, any desired stitch pattern may be formed in an edge tracing mode of sewing operation.

In the sewing machine constructed as described above, the edge sensor generates an output signal which corresponds to an area of the part of the detection area which is not covered by the fabric 70. With the output signal of the sensor applied to the delay device 112, the delayed SENSOR signal Sd is applied to the adder 130.

The time delay of the SENSOR signal Sd with respect to the output signal of the edge sensor is effected by execution of the control program represented by the flow chart of FIG. 6. Initially, step S101 is repeatedly implemented until the sewing machine is started. When the main switch 20 is turned on, step S102 is executed. In this step S102, SENSOR SIGNAL registers WR1, WR2, WR3 and WR4, and FEED AMOUNT registers FR1, FR2 and FR3 for storing feed data FD are cleared, and the penetration counter **112*a* is initialized to zero. In step S103, the delay device 112 waits for the generation of the timing pulse TP from the timing pulse generator 88. When the timing pulse TP is received by the delay device 112, the control flow goes to step S104 wherein the content "n" of the PENETRATION counter 112*a*** is incremented.

In step S105, the delay device 112 reads in the feed data FD from the feed calculating circuit 84. In step S106, the content of the FEED AMOUNT register FR2 is stored in the FEED AMOUNT register FR3, while the content of the register FR1 is stored in the register FR2, and the currently received feed data FD is stored in the register FR1. Step S106 is followed by step S107 wherein the delay device 112 reads in the output signal of the edge sensor. In the next step S108, the contents of the SENSOR SIGNAL registers WR3, WR2 and WR1 are stored in the registers WR4, WR3 and WR2, respectively, and the currently received output signal of the sensor is stored in the register WR1. With step S106 executed repeatedly, the two previous feed amounts FD which were produced two cycles and one cycle prior to the current cycle of execution of the control program are stored in the respective FEED AMOUNT registers FR3 and FR2, respectively. Step S108 is similar to step S5 of the flow chart shown in FIG. 4.

Step S109 is then executed to determine whether the content of the FEED AMOUNT register FR1 is equal to or greater than the offset distance LD between the sensor position and the lowered needle position. Step S111 is executed if an affirmative decision (YES) is obtained in step S109, or if a negative decision (NO) is obtained in step S109 and if an affirmative decision (YES) is obtained in step S110 with the content "n" of the counter **112*a* equal to "1". In step S111, the content of the register WR1 is delivered as an output of the delay device 112. In the former case, the work fabric 70 is fed by the first feed data FD such that the portion of the fabric detected by the edge sensor at least reaches the lowered position of the needle 42 by one feeding movement of the feeding device represented by the first feed data FD. Therefore, the currently received output signal stored in the SENSOR SIGNAL register WR1 is used as an output of the delay device 112. In the latter case, the first one feeding movement of the feeding device does not cause the detected portion of the fabric to reach the lowered needle position. However, the registers WR2, WR3 and WR4 do not store any output signal of the sensor, since the current control cycle is a first cycle after the start of a sewing operation. Therefore, the content of the register WR1 is used as the output of the delay device 112**.

If the content "n" of the PENETRATION counter 112*a* is not "1", and a negative decision (NO) is obtained in step S110, the control flow goes to step S112 wherein the contents of the FEED AMOUNT registers FR1 and FR2 are summed, and the obtained sum is compared with the offset distance LD, to determine whether the sum is equal to or greater than the offset distance LD. Step S114 is implemented if an affirmative decision (YES) is obtained in step S112, or if a negative decision (NO) is obtained in step S112 and if an affirmative decision (YES) is obtained in step S113 with the count "n" equal to "2". In step Sl114, the content of the SENSOR SIGNAL register WR2 is delivered from the delay device 112. In the former case, the detected portion of the fabric 70 at least reaches the lowered needle position by the first two feeding movements of the feeding device, and therefore the content of the register WR2 which was obtained one cycle prior to the current cycle is delivered as an output of the delay device 112. In the latter case, the two feeding movements do not cause the detected portion of the fabric to reach the lowered needle position. However, the registers WR3 and WR4 do not store any output signal of the sensor, since the current control cycle is a second cycle after the start of a sewing operation. Therefore, the content of the register WR2 is used as the output of the delay device 112, since the same content represents the output signal generated first by the sensor, which is presumed to be relatively near the output signal of the sensor that should be used for controlling the lateral position of the needle 42 for its second reciprocation after the start of the sewing operation.

If the content "n" of the counter 112*a* is not equal to "2" and a negative decision (NO) is obtained in step S113, the control flow goes to step S115 wherein the contents of the three FEED AMOUNT registers FR1, FR2 and FR3 are summed, and the obtained sum is compared with the offset distance LD, in order to determine whether the sum is equal to or greater than the offset distance LD. If an affirmative decision (YES) is obtained in step S115, step S116 is implemented to deliver the content of the SENSOR SIGNAL register WR3. If a negative decision (NO) is obtained in step S115, step S117 is implemented to deliver the content of the register WR4. In the former case, the detected portion of the fabric at least reaches the lowered needle position by the first three feeding movements of the fabric 70 by the feeding device, and therefore the content of the register WR3 which was obtained two cycles prior to the current cycle is used as an output of the delay device 112. In the latter case, the content of the register WR4 is used, since it is presumed to be relatively near the output signal of the sensor that should be used for the third reciprocation of the needle 42. In the present embodiment, the number of the feed amounts or data FD which are summed is equal to the number of reciprocations of the needle 42 which occur while the portion of the fabric 70 detected by the edge sensor is fed to the lowered position of the needle 42.

In step S118, the delay device 112 determines whether the relevant sewing operation is commanded to continue. If an affirmative decision (YES) is obtained in step S118, step S103 and subequent steps are repeated. If a negative decision (NO) is obtained in step S118, the control flow returns to step S101, and the delay device 112 waits for a new sewing operation. As described above in connection with the registers WR1–WR4 of the preceding embodiment, the numbers of the SENSOR SIGNAL registers WR and the FEED AMOUNT registers FR may be changed as neeeded.

The SENSOR signal Sd thus delayed by the delay device 112 is applied to the adder 130, together with the REFERENCE signal Sw from the A/D converter 118, BIGHT signal Sb from the bight calculating circuit 86 and CONSTANT signal Sc. Each time the timing pulse TP is received by the adder 130, the output signal Sp is delivered from the adder 130 and is applied to the bight control circuit 96 via the multiplexer 94. As a result, the needle bar oscillator 36 is laterally jogged based on the output signal Sp, and the needle 42 is accordingly jogged to a proper stitching position.

It will be understood from the foregoing description that the portion of the delay device 112 assigned to execute steps S103, S105–S109, S111, S112 and S114–S117 constitutes signal delay means. Further, the portion of the delay device 112 assigned to execute steps S103, S105, S106, S109, S112 and S115 constitutes summing means for summing the feed amounts FD in synchronization with the reciprocations of the needle 42. It will also be understood that the portion of the delay device 112 assigned to implement steps S109, S112 and S115 constitutes means for determining whether the sum of the feed amounts FD approximates to the offset distance LD. Further, the portion of the delay device 112 assigned to execute steps S112 and S115 constitutes sequential adding means for obtaining the sum of the contents of the FEED AMOUNT registers FR1 and FR2, and the sum of the contents of the registers FR1, FR2 and FR3.

In the preceding embodiment, the length of the time delay provided by the delay device 112 is determined based on the reference number "n" of penetrations of the needle 42 through the fabric 70, which is obtained by dividing the offset distance LD by the incremental feed distance FD (per each needle reciprocation). It will be apparent that the arrangement of the preceding embodiment is effective where the feed data FD generated upon each reciprocation of the needle 42 during an edge tracing sewing operation will not vary to a large extent, as in a straight stitching operation. In this sense, the preceding embodiment of FIG. 4 is advantageous for reducing the number of steps and processing time of the control program of the delay device 112, and reducing the cost of the device.

In the second embodiment of FIG. 6, the delay time is obtained based on the sequentially summed values of the feed amounts FD upon individual reciprocations of the needle 42. Accordingly, the second embodiment is advantageous for accurately positioning the needle 42 even where the stitching operation requires different values of feed data FD for successive reciprocations of the needle 42.

In the presently preferred embodiments which have been described in detail, the time at which the delay device 112 applies its output signal to the comparator 114 (in the first embodiment) or the adder 130 (in the second embodiment), i.e., to a portion of the position control means (114, 120, 124, 130, 94, 96), is delayed with respect to the time at which the delay device 112 receives the output signal of the edge sensor. However, the principle of the present invention may be practiced, provided that the application of the drive signal from the bight control circuit 96 to the bight control motor 100 is delayed with respect to the application of the output signal of the edge sensor to the delay device 112.

While the illustrated embodiments are adapted such that the relative position between the needle 42 and the fabric 70 is changed by laterally jogging the needle 42 by the control motor 100, the fabric 70 may be laterally moved relative to the needle 42, to control the relative position between the needle 42 and the fabric 70.

The illustrated embodiments are adapted such that the reference number "n" of penetrations of the needle 42 will not be changed even if the feed amount is adjusted after an edge tracing sewing operation is started with the main switch 20 activated. However, it is possible to change the feed amount even while an edge tracing sewing operation is being performed. In this case, the control program represented by the flow chart of FIG. 4 is modified so that the feed data FD is read in and the reference number "N" is calculated each time the timing pulse TP is generated.

It will be understood that the present invention may be embodied with various other changes, modifications and improvements, which may occur to those skilled in the art, in connection with the specific construction of the edge sensor 54, tracing control device 110, or mechanism for laterally jogging the needle 42, or the overall arrangement of the zigzag sewing machine. For example, the needle 42 may be laterally jogged by pivoting the oscillator 36 about a substantially vertical axis.

What is claimed is:

1. A sewing machine for forming successive stitches along an edge of a workpiece, comprising:
- an endwise reciprocable sewing needle;
- a feeding device for feeding the workpiece in a feed direction, in synchronization with endwise reciprocations of the needle;
- a control motor for changing a relative position between the needle and the workpiece in a lateral direction perpendicular to said feed direction;
- an edge sensor having a detection area on a work bed, and generating an output signal corresponding to a position relative to an edge of said workpiece in said detection area in said lateral direction;
- position control means for receiving said output signal from said edge sensor in synchronization with said endwise reciprocations of the needle, and applying to said control motor a drive signal to control said relative position between said needle and said edge of the workpiece, said drive signal being determined based on said output signal; and
- signal delay means for delaying the application of said drive signal to said control motor, with respect to the generation of said output signal from said edge sensor, by a time interval necessary for a feeding movement of said workpiece by said feeding device from said detection area of said edge sensor to a lowered position of said needle.

2. A sewing machine according to claim 1, wherein said delay means determines said time interval depending upon a reference number of penetrations of said needle through said workpiece which occur during said feeding movement of the workpiece, said reference number of penetrations being determined based on an amount of feed distance of the workpiece by said feeding device for each reciprocation of said needle.

3. A sewing machine according to claim 2, wherein said signal delay means comprises dividing means for dividing an offset distance in said feed direction between said detection area of said edge sensor and said lowered position of said needle, by said amount of feed distance of the workpiece by said feeding device, to determine said reference number.

4. A sewing machine according to claim 3, wherein said signal delay means further comprises:
- summing means for summing feed amounts of the workpiece by said feeding device in synchronization with said reciprocations of the needle, and thereby obtaining a sum of said feed amounts; and
- determining means for determining whether said sum sufficiently approximates to an offset distance in said feed direction between said detection area of said edge sensor and said lowered position of the needle,
- said reference number of penetrations of the needle being determined based on a number of the feed amounts which have been summed until said determining means obtains an affirmative decision.

5. A sewing machine according to claim 4, wherein said summing means comprises a plurality of feed amount registers which stores said feed amounts and which are consecutively numbered in an increasing order, and sequential adding means for adding to a content of a lowest-numbered one of said registers a content of a next one of said registers which is next to said lowest-numbered register in said increasing order, and thereby obtaining a first sum of feed amounts, said sequential adding means obtaining second and following sums of feed amounts by adding to the content of each of the following registers a sum of the contents of the registers whose numbers are smaller than that of said each of said following registers, said determining means sequentially comparing each of said first, second and following sums, with said offset distance, said determining means obtaining said affirmative decision when one of said sums exceeds said offset distance for the first time.

6. A sewing machine according to claim 2, wherein said signal delay means further comprises:
- a plurality of sensor signal registers for storing said output signal of said edge sensor, said registers being numbered by consecutive integers which are incremented from "1";
- shift control means for storing a current value of said output signal of said edge sensor in a first one of said sensor signal registers whose number is "1", each time said needle is lifted from said lowered position, said shift control means shifting contents of said sensor signal registers, from each one of said registers to a following one of the registers; and
- steady-state signal supply means for applying to said position control means the output signal stored in one of said sensor signal registers whose number is equal to said reference number of penetrations of said needle, during a steady-state period of an edge tracing sewing operation wherein an actual number of penetrations of the needle is equal to or greater than said reference number.

7. A sewing machine according to claim 6, wherein said signal delay means further comprises transient-state signal supply means for applying to said position control means the output signal stored in one of said sensor signal registers whose number is equal to said actual number of penetrations, during an initial period of said edge tracing sewing operation wherein said actual number is smaller than said reference number.

8. A sewing machine according to claim 1, wherein an amount of said feeding movement of said workpiece from said detection area of said edge sensor to said lowered position of said needle corresponds to a plurality of penetrations of said needle through said workpiece.

9. A sewing machine for forming successive stitches along an edge of a workpiece comprising:

an endwise reciprocable sewing needle;

a feeding device for feeding the workpiece in a feed direction by an incremental feed distance, in synchronization with each endwise reciprocation of the needle;

a control motor for changing a relative position between the needle and the workpiece in a lateral direction perpendicular to said feed direction;

an edge sensor having a detection area which is provided on a work bed such that said detection area is spaced away from a lowered position of the needle by a predetermined offset distance in said feed direction, said edge sensor generating an output signal corresponding to a position relative to an edge of said workpiece in said detection area in said lateral direction;

signal delay means for delaying the application of a drive signal to said control motor, with respect to the moment of generation of said output signal from said edge sensor, by a time interval corresponding to a number of penetrations of said needle through said workpiece which occur during a feeding movement of said workpiece by said feeding device from said detection area of said edge sensor to said lowered position of said needle, said signal delay means comprising dividing means for dividing said predetermined offset distance by said incremental feed distance, to determine said reference number of penetrations; and position control means for receiving a signal from said signal delay means in synchronization with said endwise reciprocation of the needle, and applying to said control motor said drive signal to control said relative position between said needle and said edge of the workpiece.

* * * * *